US006296281B1

(12) United States Patent
Stone

(10) Patent No.: US 6,296,281 B1
(45) Date of Patent: Oct. 2, 2001

(54) LATENT IMAGE STRUCTURE

(75) Inventor: David Allen Stone, Hants (GB)

(73) Assignee: De La Rue International Limited, Basingstoke (GB)

( * ) Notice: Subject to any disclaimer, the term of this patent is extended or adjusted under 35 U.S.C. 154(b) by 0 days.

(21) Appl. No.: 09/509,992

(22) PCT Filed: Mar. 19, 1999

(86) PCT No.: PCT/GB99/00878

§ 371 Date: Apr. 17, 2000

§ 102(e) Date: Apr. 17, 2000

(87) PCT Pub. No.: WO99/48697

PCT Pub. Date: Sep. 30, 1999

(30) Foreign Application Priority Data

Mar. 20, 1998 (GB) ..... 9806077

(51) Int. Cl.[7] ..... B42D 15/00
(52) U.S. Cl. ..... 283/93; 283/72; 283/91
(58) Field of Search ..... 283/72, 67, 91, 283/93, 902, 85, 113, 114, 73, 17; 359/566

(56) References Cited

U.S. PATENT DOCUMENTS 4,033,059 * 7/1977 Hutton et al. ..... 283/91
4,588,212 * 5/1986 Castagnoli ..... 283/91
4,715,623 12/1987 Roule et al. .
4,968,064 * 11/1990 Mancuso ..... 283/91
5,032,003 * 7/1991 Antes ..... 283/91 X
5,722,693 * 3/1998 Wicker ..... 283/67

FOREIGN PATENT DOCUMENTS 0 146 151 A1 6/1985 (EP) .

* cited by examiner

*Primary Examiner*—Willmon Fridie, Jr.
(74) *Attorney, Agent, or Firm*—Oliff & Berridge, PLC

(57) ABSTRACT

A latent image structure of a highly secure nature in which two latent image are superimposed. Each of the superimposed latent images is viewable from a different line of sight. Relief elements define, for each latent image, portions of respective linear relief structures providing an image and a background which cooperate to generate the latent image. Relief elements are only provided at locations where the linear relief structures of the first and second latent images intersect. The resultant latent image structure, when viewed normally, has the advantage of a relatively flat appearance, making it difficult to discern the presence either of the superimposed latent images.

16 Claims, 3 Drawing Sheets

LATENT IMAGE STRUCTURE

BACKGROUND OF THE INVENTION

1. Field of the Invention

The invention relates to a latent image structure, for example for use as a security device.

2. Description of the Related Art

A latent image is an image which cannot be seen when viewed normally (i.e. perpendicularly) but can be seen when the surface carrying the image is held at an acute angle to the eye. Conventional latent images are formed as relief structures which have sufficient height to mask certain regions when the structure is held at an acute angle. These relief structures can be form(ed by embossing or printing, typically intaglio printing. A number of different types of intaglio printed latent images are described in U.S. Pat. No. 4,033,059. In addition, this document discloses complex, multiple latent images which enable more than one latent image to be viewed when the structure is viewed at different angles. This is particularly useful where the structure is to be used as a security device.

For example, in U.S. Pat. No. 4,033,059, two superimposed latent images are described, each being formed by continuous lines. Where the two structures overlap, a different line structure is used which means that when the features are viewed from a shallow angle, the strength of the image will vary according to whether or not the image forms part of the second image area. In another form, a set of dots is used. A regular dot structure forms a bulk of the feature area with strategically placed dots so produce images in the required direction resulting in a combination of latent and transient images. This means that the presence of an image is easily seen at normal viewing and furthermore a shadow latent image only can be produced.

A problem which can arise with latent images is that although they are primarily visible only when viewed at an acute angle, nevertheless they require different line structures which are at least partially visible when the device is viewed normally. This is true, for example, of the structures described in U.S. Pat. No. 4,033,059 and reduces the security nature of the device. This problem becomes even more noticeable with multiple latent images.

SUMMARY OF THE INVENTION

In accordance with the present invention, a latent image structure comprises an array of relief elements defining i) a first latent image viewable along a first line of sight offset to the normal;

ii) a second latent image viewable along a second line of sight offset to the normal, the second line of sight being rotated laterally relative to the first line of sight about a normal to the structure, the first and second latent images being superimposed, wherein the relief elements define, for each latent image, portions of respective linear relief structures providing an image and a background which cooperate to generate the latent image, and wherein the relief elements are only provided at locations where the linear relief structures of the first and second latent images intersect.

We have devised a new latent image structure which has the significant advantage that when viewed normally it presents a relatively flat appearance from which it is difficult to discern the presence of the or each latent image. Typically, the relief elements are arranged in sets of regular arrays which are identical in form but differing in orientation in contrast to previous structures. For example, the dot relief structures described in U.S. Pat. No. 4,033,059 are irregular with the result that the latent image can be discerned when viewed normally.

A further advantage of arranging the relief elements in a set of regular arrays is that the amount of ink used per unit area, in the case where the relief elements are printed, will be substantially the same across the feature and this leads further to the flat appearance of the structure and increases the difficulty of discerning the latent image when viewed normally.

Typically, each linear relief structure is based on a pair of arrays of lines, the lines of each array being substantially parallel, and the lines of one array extending at substantially 90° to the lines of the other array. Of course, the relief elements themselves in this case are only based on lines, the lines themselves not existing. Instead, the relief elements will be in the form of discrete features such as lozenges, ellipses or dots.

The relief elements may be formed by raised portions of a substrate, for example by embossing, or by portions of ink, for example by intaglio printing.

Typically, the lines on which the relief structure is based have a substantially constant width although in some cases, the lines of at least one of the linear relief structures vary in width along their length. This may be a pseudo-random variation. This approach is described in more detail in WO-A-98/47715.

Where the structure is printed, typically all relief elements will be different colours from the underlying substrate on which the relief elements are provided. The underlying substrate could be coloured, white or patterned. The relief elements preferably have a dark colour such as black, blue, purple or green or may be of more than one colour. In some cases, the substrate could comprise self-supporting carrier such as a paper or plastics layer while in other cases the substrate may comprise a carrier on which is provided a coating, for example a varnish, lacquer etc. or printed ink or a foil. This allows a wide variety of effects to be achieved.

In some examples, each line of the linear relief structure has a width in the range 1–250 microns.

If the relief structures are printed, for example intaglio printed, then preferably the widths of the relief structures lie in the range 130–440 microns, preferably 170–250 microns.

Where the relief structures are blind embossed, thinner widths can be achieved, for example in the range 1–40 microns, preferably 1–10 microns.

Typically, the spacing between adjacent lines of each linear relief structure is a similar order of magnitude to the line width. For example, for printed relief elements, a spacing of 170–260 microns is preferred.

The latent image structure may be used in a variety of applications, but is particularly suitable as a security feature. Typical examples of items which are secured using latent images include passports, passbooks, tickets, permits, licences, financial transaction cards including cheque guarantee cards, charge cards, credit cards, cash withdrawal cards, electronic funds transfer cards, service entitlement cards, personal or article identification cards, prepayment cards, telephone cards, variable e.g. decrementing value cards, bonds, fiscal documents, bank notes, cheques including travellers cheques, vouchers, brand identification labels, tamper resisting or indicating labels.

BRIEF DESCRIPTION OF THE DRAWINGS

An example of a latent image structure according to the invention will now be described with reference to the accompanying drawings, in which.

DETAILED DESCRIPTION OF THE INVENTION

Figure 1:
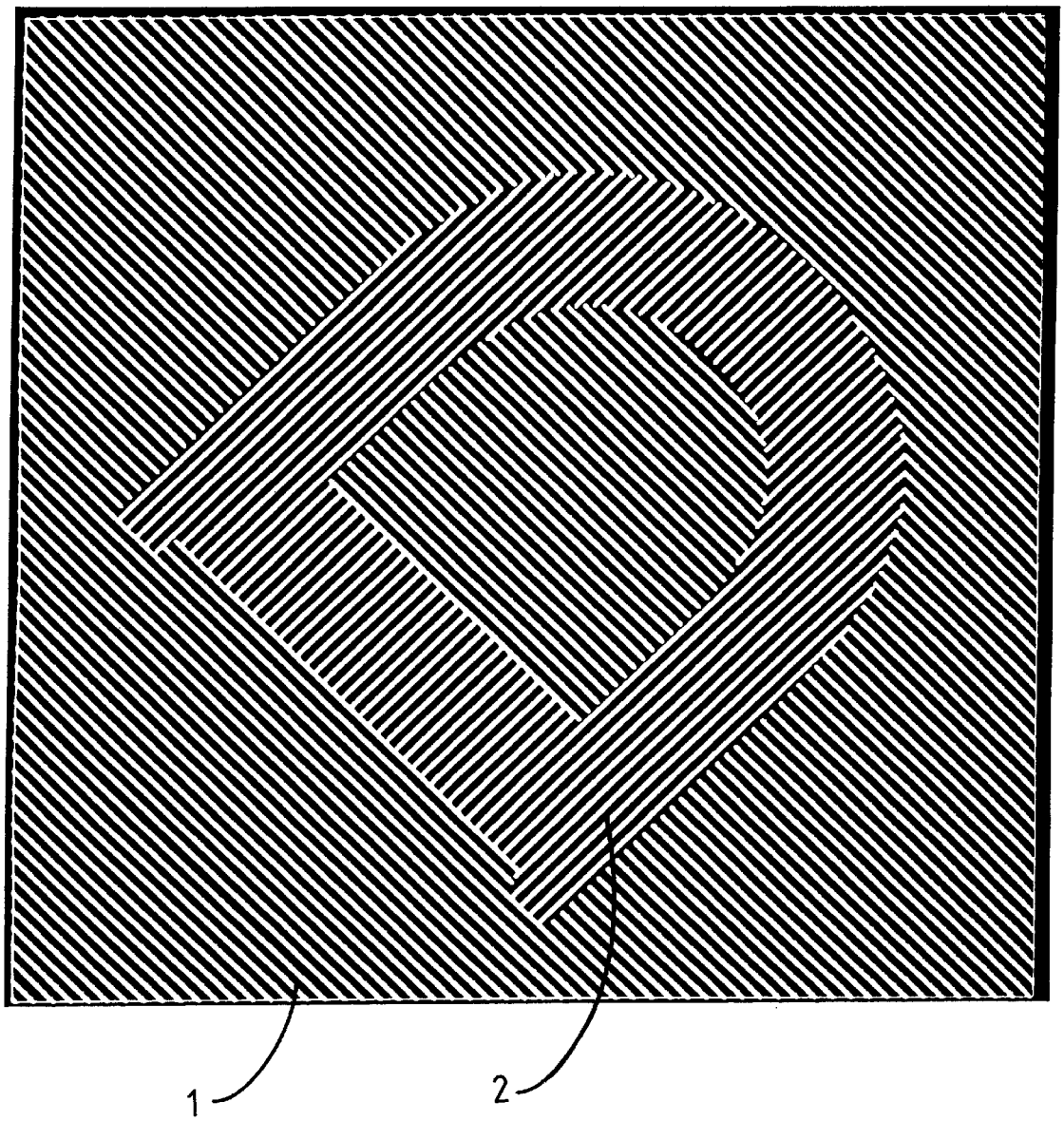
FIG. 1 is an enlarged view of a first latent image structure.

A first latent image structure is shown in FIG. 1 and comprises a set of lines 1 extending diagonally from top left to bottom right defining a background, and a set of lines 2 extending at 90° to the lines 1 defining a letter "D". The lines 1,2 will have the same colour and have heights, widths and spacing such that when viewed normally the letter "D" is not easily discernable but becomes clearly visible when viewed at an acute angle, in this case 45°.

Figure 2:
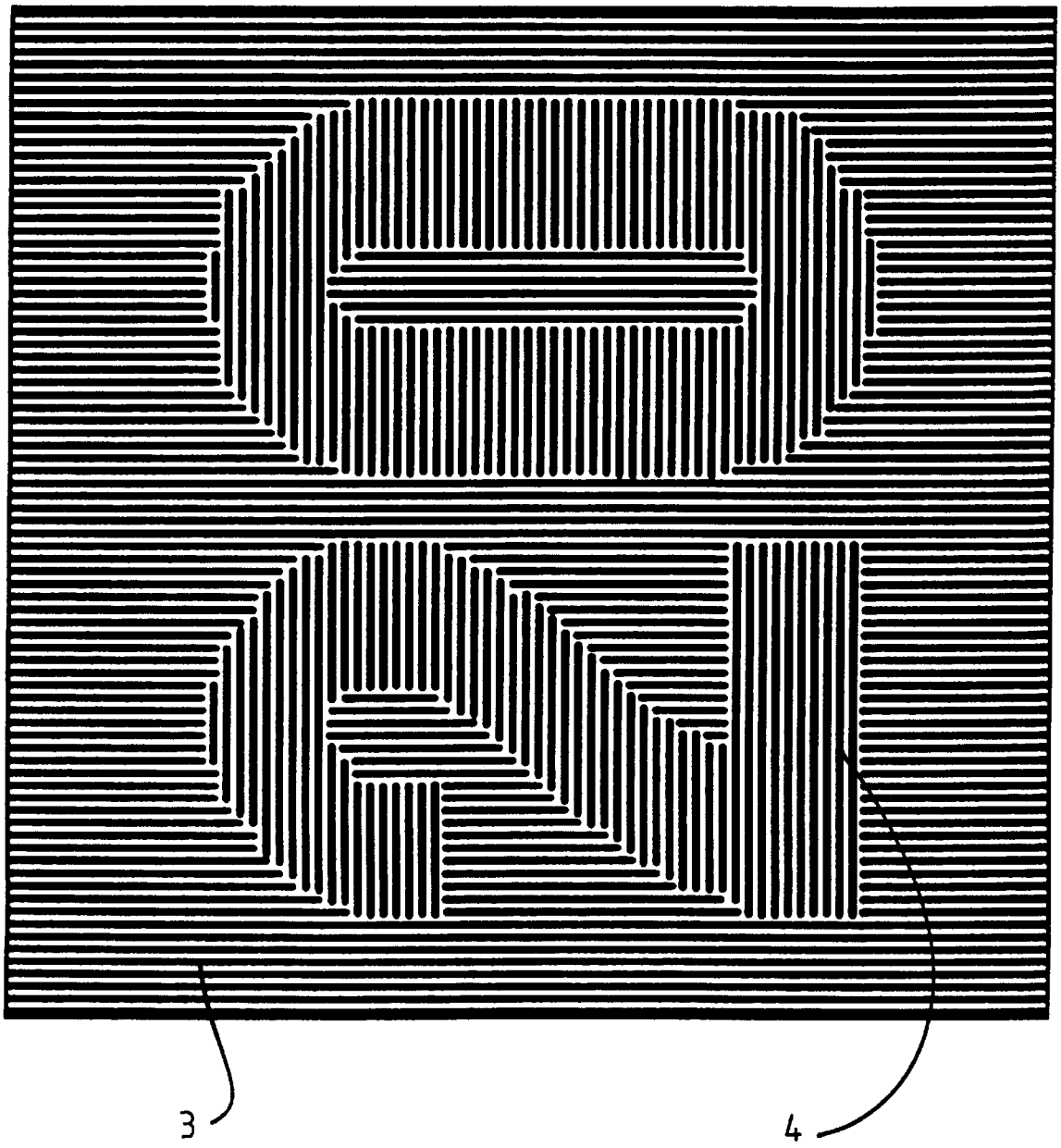
FIG. 2 is an enlarged view of a second latent image structure.

FIG. 2 illustrates a second latent image structure defined by a first array of lines 3 extending from left to right and defining a background and a second array of lines 4 extending vertically and defining the numeral "20".

Each of the structures shown in FIGS. 1 and 2 is conventional in its own right and is based, when intaglio printed, on the disclosures in U.S. Pat. No. 4,033,059. Typical line widths range from 130 $\mu$m to 250 $\mu$m, with line repeats of 220 $\mu$m to 440 $\mu$m and line to space ratios of 30–70%. It should be noted, however, that the line structures are not necessarily the same for the first and second images although in this example they are shown to be substantially the same.

Figure 3:
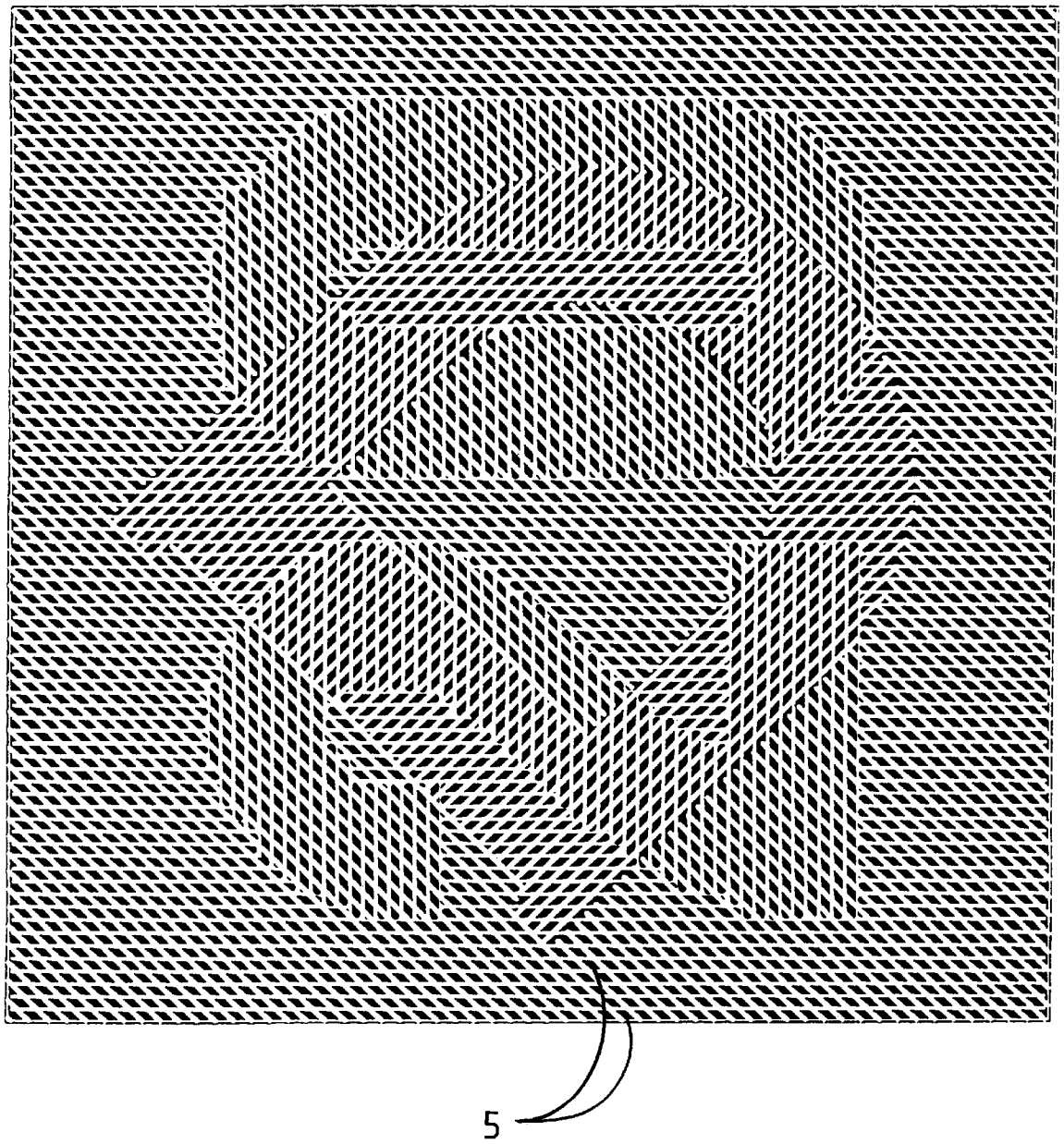
FIG. 3 is an enlarged view of the resultant latent image structure produced by combining the structures of FIGS. 1 and 2.

When the two structures are superimposed, a new structure shown in FIG. 3 is produced formed by a regular array of similarly shaped relief elements 5, each relief element being provided at the intersection between superimposed lines of the two latent image structures of FIGS. 1 and 2. In addition, any areas corresponding to spaces in either of the two latent images and their backgrounds will be spaces in the finished featured.

It will be immediately apparent from FIG. 3 that, even at this enlarged scale, the latent images are much more difficult to discern when viewed normally. This arises from a number of factors including the fact that the vast majority of the relief elements have substantially the same (in this case lozenge) shape, and the amount of ink used per unit area is substantially the same.

A further advantage of this arrangement is that both latent images will have substantially the same strength.

In the preferred arrangements, the relief elements will be printed, typically intaglio printed, on a substrate but in some cases they could be defined by raised portions of the substrate itself, for example by embossing. Where the relief elements are intaglio printed, one or more different colour splits may be introduced within or across the printed feature.

Furthermore, with the present invention, each latent image can be seen in shadow and by turning the paper through 90° in highlight in contrast to those of U.S. Pat. No. 4,033,059.

What is claimed is:

1. A latent image structure comprising an array of relief elements defining i) a first latent image viewable along a first line of sight offset to the normal;

ii) a second latent image viewable along a second line of sight offset to the normal, the second line of sight being rotated laterally relative to the first line of sight about a normal to the structure, the first and second latent images being integrated, wherein the relief elements define, for each latent image, portions of respective linear relief structures providing an image and a background which cooperate to generate the latent image, and wherein the relief elements are only provided at locations where the linear relief structures of the first and second latent images intersect.

2. A structure according to claim 1, wherein each linear relief structure is based on a pair of arrays of lines, the lines of each array being substantially parallel, and the lines of one array extending at substantially 90° to the lines of the other array.

3. A structure according to claim 2, wherein the lines defining the first latent image are at substantially 45° to the lines defining the second latent image.

4. A structure according to claim 1, wherein the relief elements are in the form of lozenges, ellipses or dots.

5. A structure according to claim 1, wherein the relief elements are defined by raised portions of a substrate.

6. A structure according to claim 5, wherein the relief elements are embossed in the substrate.

7. A structure according to claim 1, wherein the relief elements comprise portions of ink.

8. A structure according to claim 7, wherein the relief elements are intaglio printed on a substrate.

9. A structure according to any of the preceding claims, wherein each line of the linear relief structure has a width in the range 1–250 microns.

10. A structure according to claim 7 or claim 8, wherein each line of the linear relief structures has a width in the range 130–440 microns, preferably 170–250 microns.

11. A structure according to claim 10, wherein the centre-to-centre spacing of adjacent lines of each linear relief structure lies in the range 170–250 microns.

12. A structure according to any of claims 1 to 8, wherein each line of the linear relief structures has a width in the range 1–40 $\mu$m, preferably 1–10 $\mu$m.

13. A structure according to any of the preceding claims, wherein the line to space ratio of each linear relief structure is in the range 30–70%.

14. A structure according to any of the preceding claims, wherein the lines of at least one of the linear relief structures vary in width along their length.

15. A structure according to claim 14, wherein the variation is a pseudo-random variation.

16. A security document carrying a latent image structure according to any of the preceding claims.

* * * * *